United States Patent [19]

Hisao

[11] Patent Number: 4,615,383

[45] Date of Patent: Oct. 7, 1986

[54] SERPENTINE HEAT EXCHANGING APPARATUS HAVING CORRUGATED FIN UNITS

[75] Inventor: Aoki Hisao, Tamamura, Japan

[73] Assignee: Sanden Corporation, Gunma, Japan

[21] Appl. No.: 728,866

[22] Filed: Apr. 30, 1985

[30] Foreign Application Priority Data

May 1, 1984 [JP] Japan ..... 59-63002[U]

[51] Int. Cl.[4] ..... F28D 1/02; F28F 1/10

[52] U.S. Cl. ..... 165/150; 165/152; 165/172

[58] Field of Search ..... 165/150, 172, 152

[56] References Cited

U.S. PATENT DOCUMENTS

| | | | |
|---|---|---|---|
| 1,799,626 | 4/1931 | Keith, Jr. | 165/172 X |
| 2,322,145 | 6/1943 | Kritzer | 165/150 X |
| 2,792,201 | 5/1957 | Whistler, Jr. | 165/150 X |
| 2,886,296 | 5/1959 | Wright | 165/150 |
| 3,042,380 | 7/1962 | Karmazin | 165/150 X |
| 3,196,939 | 7/1965 | Erbe et al. | 165/150 X |
| 4,386,652 | 6/1983 | Dragojevic | 165/150 X |

FOREIGN PATENT DOCUMENTS

| | | | |
|---|---|---|---|
| 513573 | 9/1952 | Belgium | 165/150 |
| 66267 | 1/1948 | Denmark | 165/150 |
| 1239331 | 4/1967 | Fed. Rep. of Germany | 165/172 |
| 2506559 | 8/1975 | Fed. Rep. of Germany | 165/150 |
| 1209680 | 3/1960 | France | 165/150 |
| 614741 | 1/1961 | Italy | 165/152 |
| 0105690 | 7/1982 | Japan | 165/150 |

*Primary Examiner*—Albert W. Davis, Jr.
*Assistant Examiner*—Randolph A. Smith
*Attorney, Agent, or Firm*—Banner, Birch, McKie & Beckett

[57] ABSTRACT

A serpentine type heat exchanger for use in, for example, an evaporator or condenser in an automobile air conditioner comprises a flat tube provided with a plurality of refrigerant passages therein and bent to form a serpentine tortuous cross section. Corrugated fin units which are folded into wavy form are attached to adjacent parallel portions of the flat tube. The serpentine tortuous flat tube consists of a plurality of parallel portions spaced apart from each other in the longitudinal direction of the tube and a plurality of connecting portions each connecting with two of the adjacent parallel portions. Each connecting portion consists of a plurality of arc shaped segments and at least one central connecting segment. Therefore, the height of the heat exchanger is reduced without reducing the heat exchanging area.

2 Claims, 6 Drawing Figures

SERPENTINE HEAT EXCHANGING APPARATUS HAVING CORRUGATED FIN UNITS

BACKGROUND OF THE INVENTION

This invention relates to a heat exchanging apparatus, and more particularly to a refrigerant evaporator or condenser for use in, for example, an automobile air conditioner.

Heat exchanging apparatus, such as the serpentine type heat exchanger, is well known as suitable for use in automobile air conditioners as the evaporator or condenser. A prior art serpentine type heat exchanger is illustrated on FIGS. 1 and 2 which show the evaporator.

The evaporator comprises a flat tube 1 which has a multichannel internal construction formed with a number of parallel channels (not shown) and is bent into the form of a serpentine tortuous cross section. One end of flat tube 1 is brazed to an inlet pipe 2 which comunicates which a decompression or expansion means (not shown) in a refrigerating circuit. Therefore, refrigerant flows from inlet pipe 2 into the channels of flat tube 1 and flows from the outlet of outlet pipe 3 into the compressor. A corrugated fin unit 4 is disposed between each of the adjacent or opposed upright portions of flat tube 1, the unit being securely joined to such portions by brazing along their horizontal lines of contact. A protective plate 5 is securely joined by being brazed to each of the corrugated fin units 4 which are joined to the outermost upright portions of flat tube 1, respectively.

In an evaporator with the above-described construction, flat tube 1 as shown on FIG. 2 has the upright portions facing one another connected by an arcuately curved section 1*b*. For this reason, the corrugated fin unit cannot be disposed within the arcuately curved section 1*b*. Thus almost all of the air passing through the space within this arcuately curved section 1*b* moves through without heat exchange with the refrigerant. The efficiency of heat exchange is therefore undesirably reduced.

One solution for solving the above problem is to cover the arcuately curved sections 1*b* with an air shield plate 6 (FIG. 2) which is integrally formed with a cooling case to prevent the air-flow from passing through the space within arcuately curved sections 1*b*. However, the air space which is covered by shield plate 6 becomes unavailable space for heat exchange. Therefore, the space efficiency of the heat exchanger, i.e., the ratio of the area which is usefully heat exchanged with air to the volume of the heat exchanger, is reduced.

SUMMARY OF THE INVENTION

It is a primary object of the invention to provide an improved heat exchanger which achieves a high efficiency of heat exchange.

It is another object of this invention to provide a heat exchanger wherein the space efficiency is improved, accomplishing this with a compact size while the same heat exchanger volume as prior exchangers is maintained.

The heat exchanger in accordance with the present invention comprises a flat tube which is provided with a plurality of passages therein and bent to form a serpentine tortuous cross section. The heat exchanger with serpentine tortuous cross section has a plurality of parallel portions spaced apart from each other to form horizontal passages for air and connecting portions connected with adjacent ends of these parallel portions. A plurality of corrugated fin units, each of which is folded into a wavy form, are interposed within the horizontal passages, respectively.

Each connecting portion of the flat tube consists of a plurality of arc shaped curved segments connected respectively to adjacent ends of parallel portions of the flat tube, and a center connecting segment connected to the arc shaped curved segments, this connecting segment being curved inwardly to contact against the fin unit in the horizontal passage between adjacent parallel portions.

DETAILED DESCRIPTION OF THE PREFERRED EMBODIMENT

Figure 1:
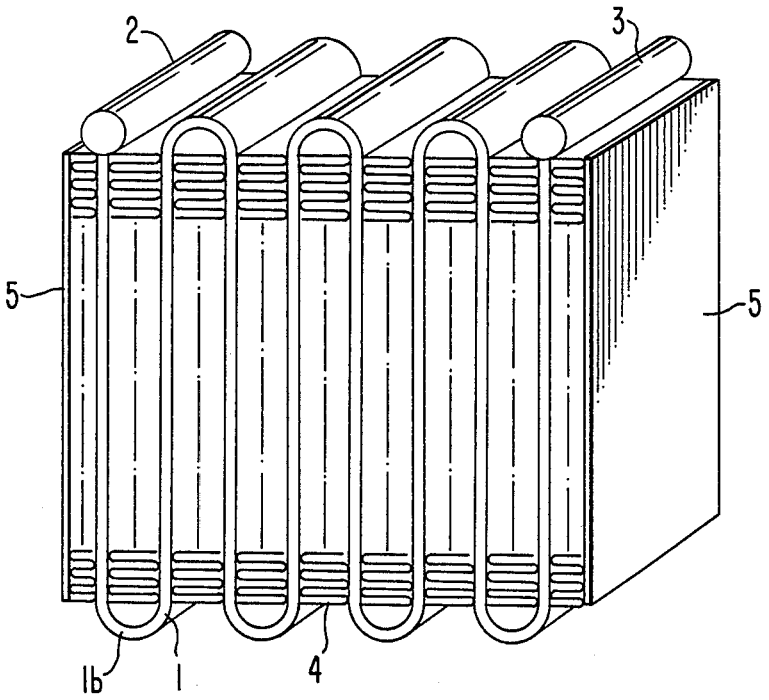
FIG. 1 PRIOR ART
FIG. 1 is a perspective view of a prior art serpentine type evaporator to illustrate its basic construction.
Figure 2:
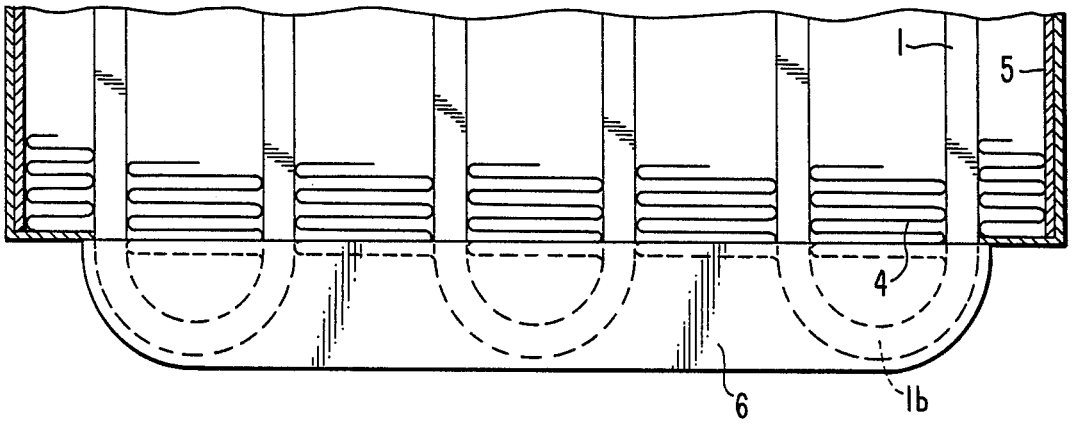
FIG. 2 PRIOR ART
FIG. 2 is an enlarged front view of a portion of the evaporator of FIG. 1 which is provided with an air cooling shield plate.
Figure 3:
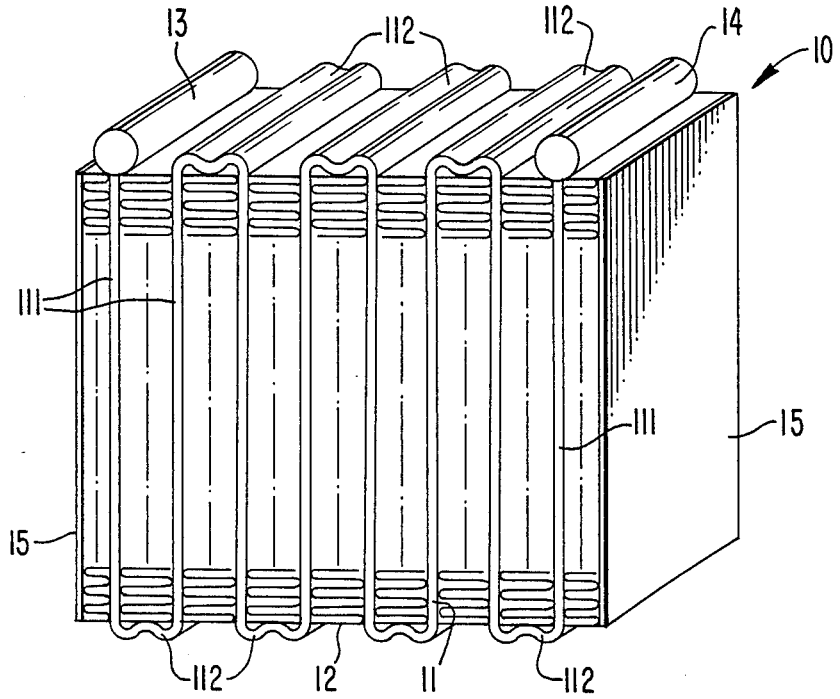
FIG. 3 is a perspective view of a serpentine type evaporator in accordance with the present invention.
Figure 4:
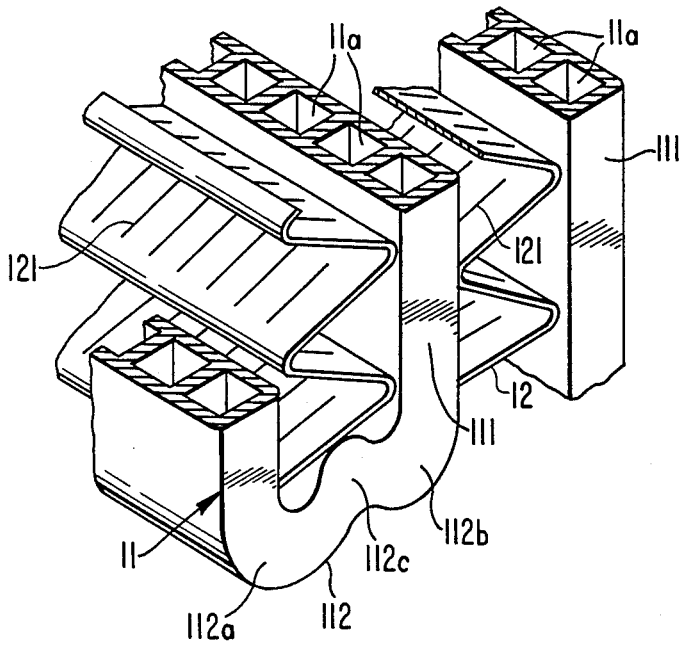
FIG. 4 is a partial cut-away perspective view of a serpentine type evaporator as shown in FIG. 3.

Referring to FIGS. 3 and 4, a serpentine type heat exchanging apparatus in accordance with the present invention is shown in the form of a refrigerant evaporator 10. Refrigerant evaporator 10 comprises a flat tube 11 which is made of aluminum and bent into a serpentine tortuous cross section of a longitudinal direction thereof. Corrugated fin units 12, each of which is made of aluminum and folded into wavy form, are disposed between the opposed parallel portions of the flat tube 11.

When flat tube 11 is bent to form the serpentine tortuous cross section, flat tube 11 consists of a plurality of parallel portions 111 spaced apart from each other in the longitudinal direction of the tube, forming a gap between adjacent parallel portions 111, and a plurality of connecting portions 112, each portion 112 connecting with two of the adjacent parallel portions. Connecting portions 112 ensure the capability for flow of refrigerant alternately in opposite directions. When flat tube 11 is positioned to have its parallel portions 111 extending in a vertical direction as shown in FIG. 3, the connecting portions 112 consist of upwardly curved upper portions and downwardly curved lower portions.

As shown in FIG. 4, flat tube 11 is divided into a plurality of refrigerant passageways 11*a* in order to improve the heat transfer rate. Referring to FIG. 3, one end of the flat tube 11 is brazed to an inlet pipe 13 which communicates with an expansion valve (not shown) in a refrigerant circuit. An outlet pipe 14 which communicates with the suction portion of a refrigerant compressor (not shown) in the refrigerant circuit is brazed on the other end of the flat tube 11.

Figure 5:
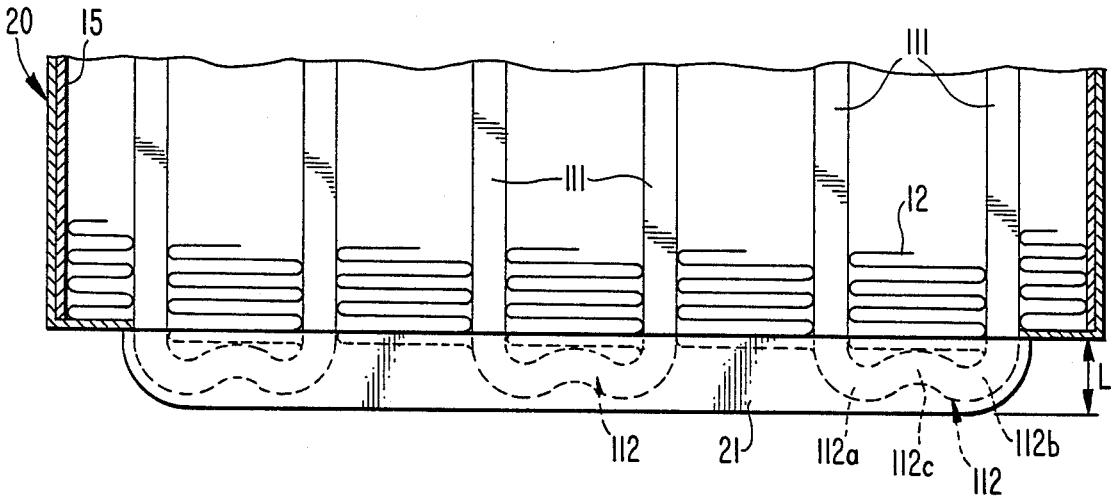
FIG. 5 is an enlarged front view of a portion of an evaporator as shown in FIG. 3 which is provided with a cooling case.

In the evaporator 10 with the above described construction, each connecting portion 112 comprises a pluality of arc shaped curvatures, as shown in FIGS. 3 and 5. That is, connecting portion 112 comprises two inwardly facing arc shaped segments 112*a* and 112*b*, each of which has one end connected with one end of a parallel portion 111 of flat tube 11 and an outwardly facing arc shaped segment 112*c* which is connected between the two inwardly facing arc shaped segments 112*a* and 112*b*. Therefore, connecting portion 112 is formed with a generally M-shaped cross section.

If evaporator 10 is placed in a cooling case 20, connecting portions 112 are covered by a shield plate 21 which is formed integral with cooling case 20, as shown in FIG. 5. In this arrangement, since the vertical height of connecting portion 112 (this height being indicated by L in FIG. 5) can be designed shorter than prior evaporator structures, the shielded space of the evaporator where flow of heat exchanging air is prevented, is reduced. Therefore, the space factor of the evaporator is improved, i.e., open space of the evaporator which is perpendicular to the air flow direction can be reduced while still maintaining the same space heat exchanging area.

Figure 6:
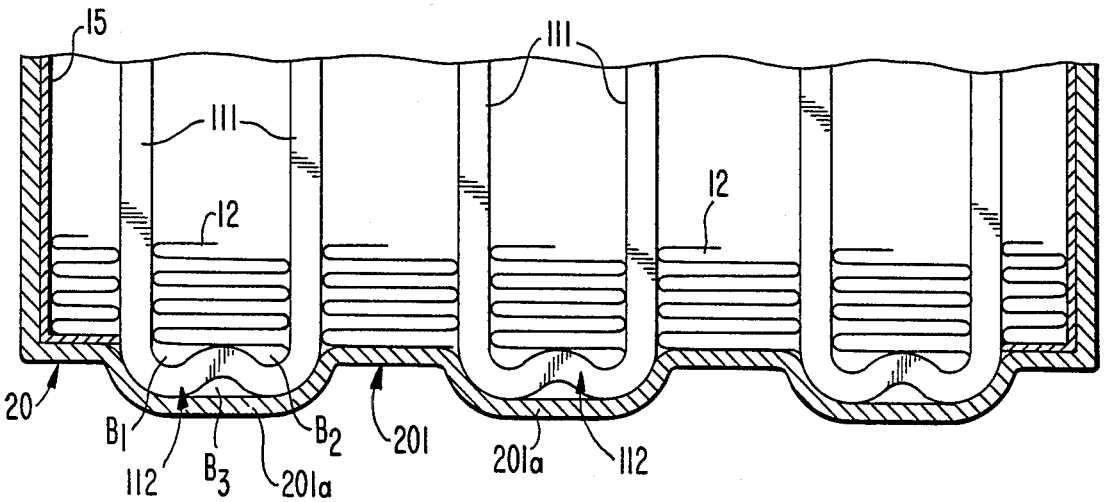
FIG. 6 is an enlarged front view similar to the portion shown in FIG. 5 illustrating a further arrangement for the cooling case.

Furthermore, if the outer portions of connecting portions 112 are covered by indentations 201*a* which are integrally formed with lower shield plate 201 and upper shield plate of cooling cover 20, (only lower plate 201 being shown in FIG. 6), heat exchange air passage spaces $B_1$, $B_2$ and $B_3$ is not so large an area. Therefore, the air passed through these spaces is sufficiently heat exchanged with the refrigerant through the connecting portions 112 of flat tube 11.

As mentioned above, the connecting portion of the serpentine type heat exchanger is formed with a generally M-shaped cross section. Therefore, the vertical height of connecting portions 112 in which the corrugated fin units are disposed can be reduced. Thus the extent of open space in evaporator 10 which does not contribute to heat exchange is reduced without influencing the extent of heat exchanging area.

This invention has been described in detail in connection with the preferred embodiments, but these are examples only and this invention is not restricted thereto. It will be easily understood by those skilled in the art that other variations and modifications can be made within the scope of this invention.

What is claimed is:

1. In a serpentine type heat exchanging apparatus comprising a tube device provided with a plurality of refrigerant passages therein, said tube device being bent to define a serpentine tortuous cross section having a plurality of parallel portions spaced apart from each other to form horizontal passages for air to be heat exchanged and connecting portions connecting adjacent ends of said parallel portions, and corrugated fin units folded into wavy form are interposed within each of said horizontal passages, respectively, to provide outermost end fins on each fin unit in each horizontal passage the improvement comprising each said connecting portion having a plurality of arc shaped segments alternatively connected between opposed parallel portions of said tube device at adjacent upper and lower ends of said portions including at least one outwardly facing arc segment at the center portion of said connecting portion with an inner surface of said outwardly facing arc segment being engaged with the outermost end fin of the fin unit in each said horizontal passage.

2. A refrigerant evaporator for use in a refrigerating circuit comprising:

a tube device provided with a plurality of refrigerant passages therein and bent to form a serpentine tortuous cross section, said device having a plurality of parallel portions spaced apart from each other to form horizontal passages for air to be passed therethrough, and connecting portions connected with opposed parallel portions of said tube device;

a plurality of corrugated fin units each folded into a wavy form, one said unit being disposed within each of said horizontal passages;

an inlet pipe fixed on one end of said tube device and an outlet pipe fixed on the other end of said tube device;

each said connecting portion of the serpentine tortuous cross section consisting of two inwardly facing arc segments and an outwardly facing arc segment forming the center section of said connecting portion; and wherein an inner surface of an outwardly facing segment is engaged with an outermost end fin of the fin unit in each said horizontal passage.

* * * * *